United States Patent [19]

Heider et al.

[11] Patent Number: 4,935,660

[45] Date of Patent: Jun. 19, 1990

[54] SINGLE-ENDED COMPACT HALOGEN DISCHARGE LAMP AND REFLECTOR COMBINATION

[75] Inventors: Jürgen Heider; Manfred Gurel, both of Munich, Fed. Rep. of Germany

[73] Assignee: Patent Treuhand Gesellschaft für Elektrische Glühlampen m.b.H., Munich, Fed. Rep. of Germany

[21] Appl. No.: 310,524

[22] Filed: Feb. 14, 1989

[30] Foreign Application Priority Data

Mar. 22, 1988 [DE] Fed. Rep. of Germany ... 8803881[U]

[51] Int. Cl.[5] ..... H01J 17/16; H01J 61/34

[52] U.S. Cl. ..... 313/25; 313/113

[58] Field of Search ..... 313/113, 25; 362/296, 362/310

[56] References Cited

U.S. PATENT DOCUMENTS 3,931,536 1/1976 Fohl et al. ..... 313/113
4,307,315 12/1981 Meulemans et al. ..... 313/634 X
4,623,815 11/1986 Krieg ..... 313/25 X
4,717,852 1/1988 Dobrusskin ..... 313/25
4,799,135 1/1989 Inukai et al. ..... 313/113 X

FOREIGN PATENT DOCUMENTS 2840771 3/1980 Fed. Rep. of Germany .
2023339 12/1979 United Kingdom .

*Primary Examiner*—Sandra L. O'Shea
*Attorney, Agent, or Firm*—Frishauf, Holtz, Goodman & Woodward

[57] ABSTRACT

To permit use of a metal halide discharge lamp for general service illumination requiring a color temperature of below 4100 K., and preferably about 4000 K., or even less, for example about 3500 K., a metal halide discharge lamp is fitted into a reflector and closely surrounded by a closed transparent tube of hard glass or quartz glass, which may be coated with an indium-tin-oxide (ITO) layer. The surrounding tube is retained against the base structure of the lamp adjacent the reflector apex, or fitted against the reflector, and closed at the other end either by an end cap integral with the tube, or by a separate cap element, retrained in position by a bridging strip spanning the light exit opening of the reflector. Preferably, the reflector is faceted.

20 Claims, 4 Drawing Sheets

SINGLE-ENDED COMPACT HALOGEN DISCHARGE LAMP AND REFLECTOR COMBINATION

FIELD OF THE INVENTION

Reference to related patents, assigned to the assignee of the present application, the disclosure of which is hereby incorporated by reference:

U.S. Pat. No. 4,623,815, Krieg et al;

U.S. Pat. No. 4,717,852, Dobrusskin et al.

Reference to related patent, the disclosure of which is hereby incorporated by reference:

U.S. Pat. No. 4,386,292.

Reference to related publications:

British Patent No. 2,023,339, Ainsworth;

German Patent Disclosure Document:

DE-OS 28 440 771, Fromm et al.

The present invention relates to a compact reflector lamp, and more particularly to the combination of a single-ended halogen metal discharge lamp with a reflector, which is suitable for general service illumination and in which the operating parameters of the light source of the lamp-reflector combination are controlled to provide light which has a color temperature and color index which is suitable for general service illumination applications.

BACKGROUND

British Patent No. 2,023,339, Ainsworth, describes a lamp with a metal halidefill. This lamp has comparatively high output, for example 200 W, and is intended to be used as a projection lamp. The reflector diameter is comparatively small, having a cross section of about 6 cm. The fill of the lamp must be carefully selected, so that the light which is generated is, essentially, "white" light, that is, light having a high color temperature in the order of 5000 K, see also U.S. Pat. No. 4,396,292.

Color temperature generally is a function of output power and the overall temperature conditions of operation of the lamp. The impression of the spectral distribution of the light delivered by the lamp is obtained by superposition of various emission lines. The mercury emission lines and the emission lines of metal halides are superposed. The respective emission lines of light of the metal halides depend highly on the vapor density and pressure within the discharge vessel. For a high color temperature as used in projection lamps, a fill having low vapor density and pressure of the metal halides is sufficient as the emission of the metal halides is to a large extent in the long wave range of the visible spectrum, the main portion of the emission spectrum of the fill - metal halides and mercury - lying withing the shorter wave range of the visible spectrum.

Reflector lamps with metal halide fills suitable for general service illumination, that is, for example for ordinary room illumination, and particularly such lamps of low power, require a lower color temperature than projection lamps. The color temperature should be substantially lower with respect to projection lamps and, preferably, should be at about 3500 K. With respect to the fill, this corresponds to a high vapor density and pressure of the metal halides to obtain an increased proportion of long-wave radiation within the emission spectrum.

Lamps suitable for general service illumination, that is, for example for general interior room illumination, should have power ratings of between 35 to 70 W, that is, comparatively low power. On the other hand, the color temperature of lamps used for room illumination requires high vapor pressure and density of the metal halides, for example of sodium which, however, is difficult to obtain due to the over-proportional thermal losses which occur in operation of low power lamps. In reflector lamps for projection, even for small power, metal halide fills are quite suitable. However, unless special measures are used, the vapor pressure and density obtained therein is not sufficient for general room illumination.

Various solutions have been proposed to permit the use of metal halide fill reflector-type discharge lamps for general service illumination; one such solution is described in German Patent Disclosure Document DE-OS 28 40 771. This is a double-ended lamp, which is located axially within an external bulb or housing element formed as a reflector. The heat balance and heat distribution obtained is enhanced by an open cylindrical tube which surrounds the discharge vessel within the outer bulb element, and is held therein by a comparatively complex holding structure. Such a construction is difficult and expensive to make. The lamp is comparatively heavy and has a long axial dimension.

THE INVENTION

It is an object to provide a lamp-reflector combination which is simple, easy to make, and has a color temperature which is so low that it can be used for general service illumination; further, the lamp should be compact and axially short.

Briefly, the color temperature of the light emitted from the light source of the lamp or light source—reflector combination is controlled by controlling the operating temperature of the light source. This is obtained by surrounding the discharge vessel of the discharge lamp by a tubular element. The tubular element closely surrounds the discharge vessel, and is seated directly, or by an intermediate element, on the reflector just outside of a reflector opening through which the light source is inserted into the reflector. The other end of the tubular element is closed, either by forming the tubular element with a closed cap or by closing an otherwise open tube with a cap element which can be held by a cross rib or strip extending across the open end of the reflector.

The tubular element, which is made of transparent material, such as quartz glass or hard glass, acts as a heat dam which prevents radiation of heat from the discharge vessel and inhibits convection heat. The tubular element is effectively closed at both ends—one end against the reflector and the other end by a cap or by a closure of the tube itself. At the side fitting against the reflector, the tubular element is engaged against the bottom of the reflector, directly or indirectly; at the side remote from the base end, at which the tube is engaged against the reflector, an extra cap can be placed on the otherwise open tube, which, simultaneously, forms a hand grip and cap (see, for example, U.S. Pat. No. 4,623,815, Krieg et al, assigned to the assignee of the present application). The heat damming effect can be further enhanced by a closing disk. In addition thereto, or rather than using a closing disk, special cover layers can be used to reflect or control heat transmission.

The lamp—reflector combination has a particularly high light output if the reflector is faceted or ribbed or formed with special reflecting surfaces.

It has previously been proposed - see U.S. Pat. No. 4,717,852, Dobrusskin et al, assigned to the assignee of the present application—to surround a metal halide lamp with an outer bulb or outer surrounding vessel. The solution suggested in the aforementioned Dobrusskin patent cannot be used, however, in a lamp—reflector combination for general service illumination since the prior solution was not sufficiently compact to permit the light source to be combined with such a reflector. The reflector—lamp combination for general service illumination must be so arranged that the reflector is formed with a rather small central opening along the apex thereof through which the light source is inserted. Using the lamp described in the aforementioned Dobrusskin patent would increase the overall dimension, and particularly the axial dimension of the lamp, to an unacceptable degree. The radiation angle of the reflector, of between 3° to 30°, could not be maintained.

The construction of the lamp in accordance with the present invention has the additional advantage that fills which are used with other types of lamps can be utilized in the lamp of the present invention, so that no special fill compositions must be prepared to fill the lamp in accordance with the present invention. This is obtained by the construction which provides for heat damming and heat collection of the light source—reflector combination.

Drawings, illustrating various examples of lamps and reflectors in accordance with the present invention:

DETAILED DESCRIPTION

The present invention is particularly applicable to low-power compact reflector lamps. "Low-power" lamps are lamps having power ratings in the order of between about 35 W to70 W; these ratings are not critical, and lower powered lamps, as well as lamps of higher power, can be made in accordance with the present invention.

Figure 1:
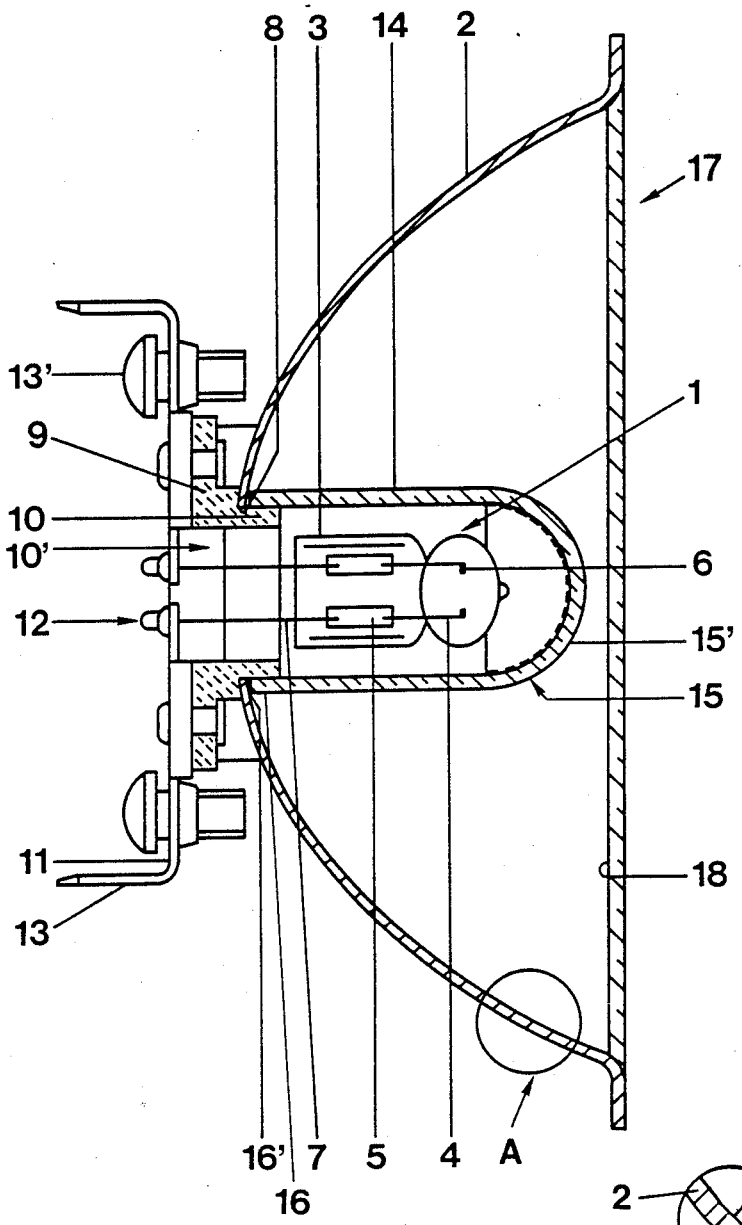
FIG. 1 is a schematic axial cross-sectional view through a reflector—lamp combination of the present invention.
Figure 1A:
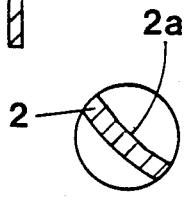
FIG. 1A is a detailed view to a larger scale, of the portion within the circle A of FIG. 1.

The lamp of FIG. 1 is shown to include a discharge vessel 1, generally in form of an ellipsoid, and made of quartz glass. It is retained axially in a metal reflector 2 made of pure aluminum, about 0.8 mm thick, and having a parabolic inner surface. It is a highly reflecting mirror surface, for example, with a high reflectivity, shiny elox surface. Preferably, the inner surface is formed with a plurality of facets or special reflecting surfaces 2*a*, as seen in the detail view of FIG. 1A. The overall diameter of the reflector is, for example, about 8 cm.

The discharge vessel 1 terminates in a pinch or press seal 3, which retains two electrode shafts 4, directed parallel to the axis of the lamp. The electrode shafts 4 are sealed in the pinch or press seal by molybdenum foils 5, which are connected to external lamp connection leads 7. The electrode tips 6 are angled off transversely with respect to the lamp axis. The inner volume of the discharge vessel 1 contains a fill of mercury with halogen additives of sodium, tin and thallium. Argon is used as an ignition gas. The lamp current is between about 0.5 to 1 amperes, and energy is supplied from the external current supply leads 7.

The reflector 2 is formed to define an apex, in which a circular opening 8 is cut, covered from the back side by a base block 9 made of temperature-resistant material, for example ceramics—see, for example, U.S. Pat. No. 4,623,815, Krieg et al, assigned to the assignee of the present application. The base block 9 has a raised center part 10 which passes through the opening 8 of the reflector. The base block 9, essentially, is a rectangular or cylindrical block structure. The center portion 10 has a central opening 10′ extending therethrough to permit the current supply leads 7 from the discharge vessel 1 to pass through the base block 9. The base block 9 is curved so that it provides an engagement surface for the curvature of the reflector; the curvature of the base block 9 matches that of the reflector. The base block 9 is formed with four slits—not visible in the drawings—which are pushed over four flaps formed on the reflector in the central or apex region thereof.

The reflector is secured to the base block 9 by twisting end portions of the flaps which extend over the slits. Solid contact spades 11 connect the current supply leads 7 to the light source or lamp 1. The contact blades or spades 11 are secured to the base block 9 by rivets. The blades 11 extend into the central, essentially square opening 10′ of the base block and are there formed with eyes 12 to provide contact terminal arrangements for the current supply leads 7. The hooked ends 13 of the contact blades 11 are shaped to receive flat matching connection push-on terminals, to permit connection to suitable fixtures or sockets of standard construction. Alternatively, connection can be made by wrapping a connecting wire about the shaft of clamping screws 13′.

In accordance with a feature of the present invention, a cylindrical tube 14 of hard glass or quartz glass surrounds the discharge vessel 1. Preferably, the cylindrical tube 14 is coated with an indium-tin oxide layer (ITO-layer). Such layers are transparent for visible light, but reflect infrared or heat radiation. The end 15 of the tube remote from the reflector end 16 thereof is closed to form a cap, integral with the tube. The cap is covered with a mirror surface, to shield direct radiation from the light source. The mirror surface, preferably, is located at the inside of the tube at the cap end, as schematically indicated in FIG. 1 by the broken lines at the inside of the cap 15′ of the tube 14.

The end 16 of the tube 14 is open, and engaged against the inside of the reflector 2 to form a heat damming and heat retention chamber. It is secured to the central portion 10 of the base block 9 with cement, to retain it in position. A cover disk or cover element 18 closes off the light emission opening 17 of the reflector. The cement connecting the central portion of the base block 10 and, hence, forming the heat damming or heat retention chamber, is schematically shown at 16′ in FIG. 1, which also closes off the heat tube 14 against the reflector.

Figure 4:
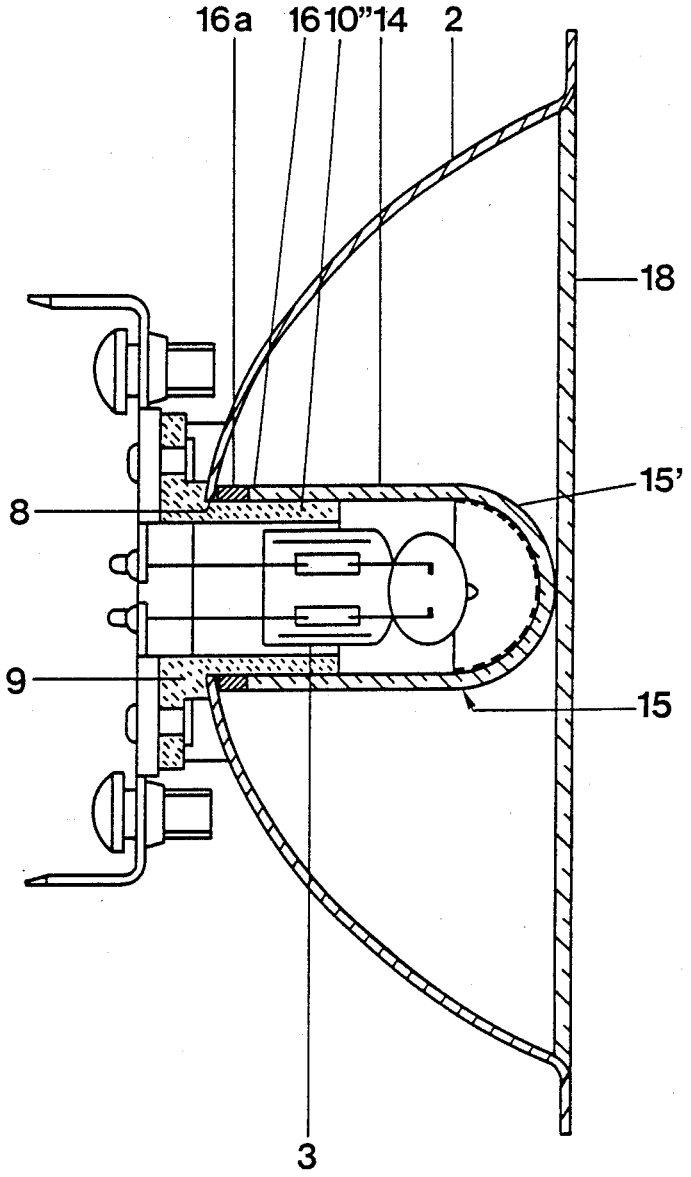
FIG. 4 is an axial sectional view through the lamp of a fourth embodiment.

Various changes and modifications may be made to form the heat retention chamber, and retain it within the reflector while permitting a construction which is compact and axially short. FIG. 4 illustrates a different attachment of the tubular element 14. The heat damming tube 14 is closed off at the end 15 remote from the base as in the embodiment of FIG. 1; it engages with the outer surface of the end cap directly against the cover disk 18. The end 16 adjacent the reflector is fitted against the reflector 2 by a metal ring 16a, which may be a leaf spring or a spring ring, engaging, respectively the reflector 2 and the tubular element 14, and holding it in engagement with the cover disk 18. The central portion 10 is extended forwardly as seen at 10'' for guidance of the heat damming tube 14 which, by this construction, can expand to accommodate thermal expansion of the tubular element 14. The central part 10'' is extended roughly up to and over part of the pinch or press seal 3 of the light source 1.

Figure 2:
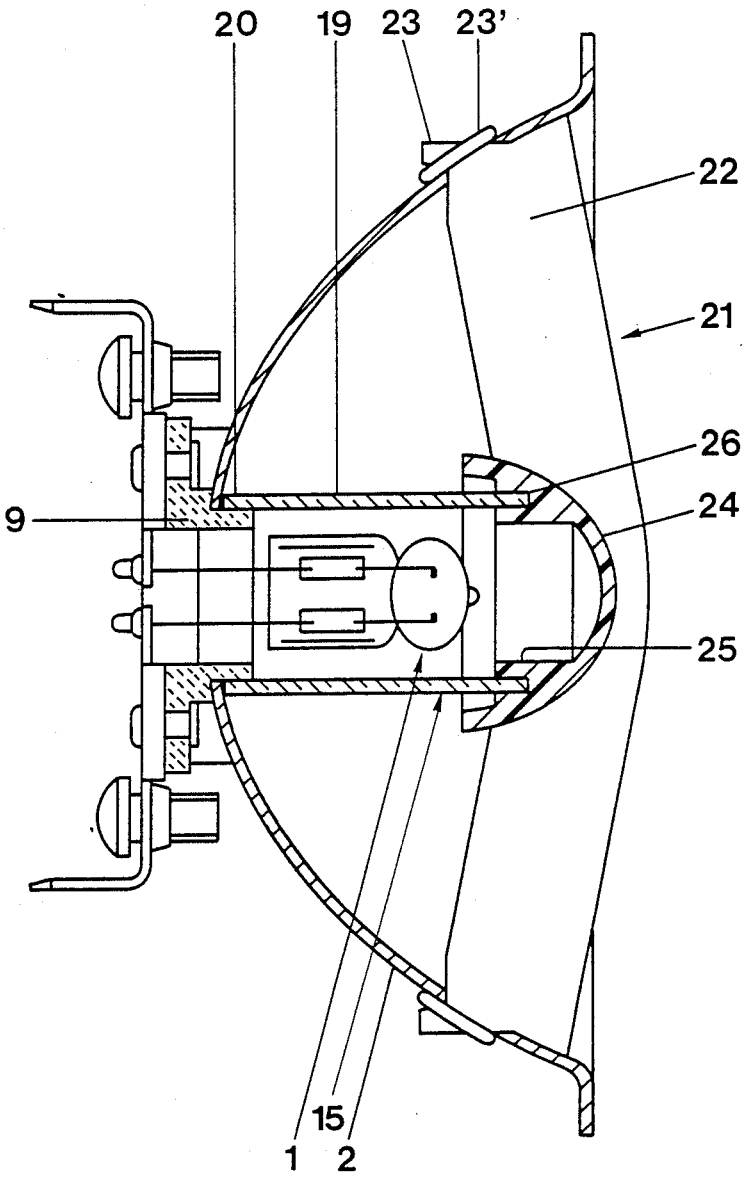
FIG. 2 is an axial sectional view through the lamp of a second embodiment.
Figure 3:
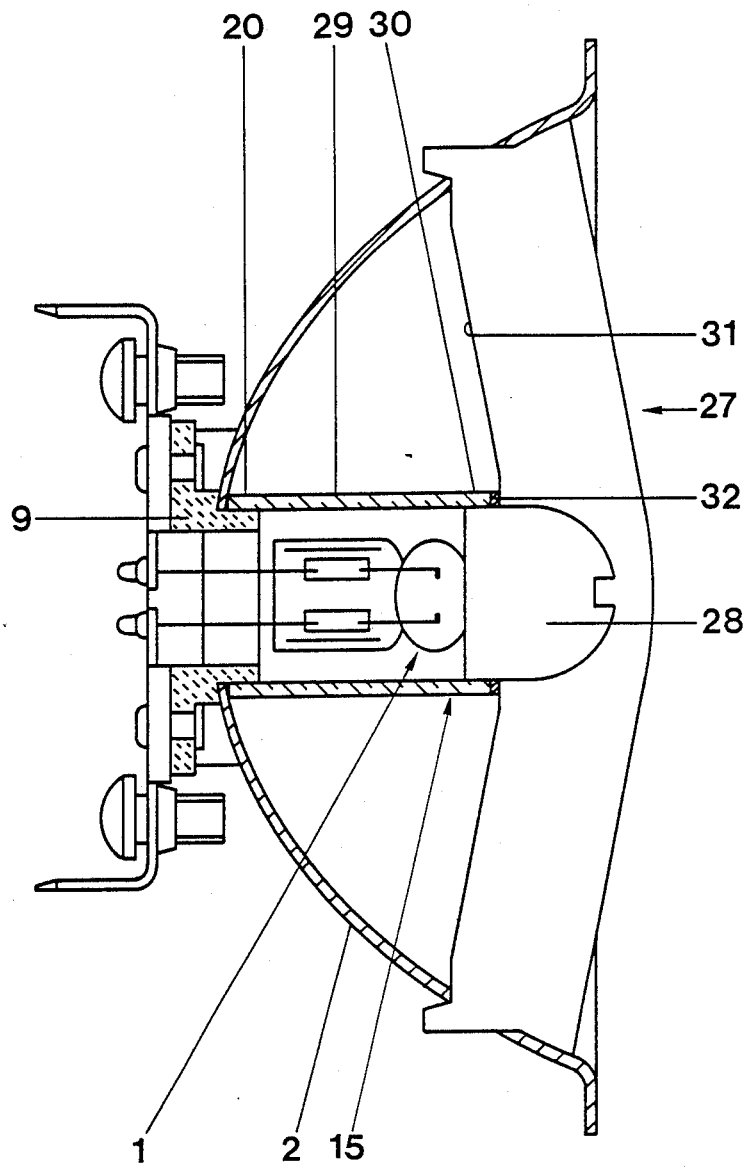
FIG. 3 is an axial sectional view through the lamp of a third embodiment.

FIG. 2 and 3 illustrate an arrangement in which the tubular element 14 is open at both ends, and closed at the end remote from the base by a cap structure which is not integral with the tubular element as such.

The general lamp structures of the lamps of FIGS. 2 and 3 are identical to that of FIG. 1. The cylindrical tubular element 19 is made of quartz glass and does not have any additional coating.

The end 20 of the tubular element 19 engages merely against the inner surface of the reflector. The reflector 2 is formed with a handling unit 21 of high temperature resistant plastic. The handling unit 21 has a flat strip 22 which extends in form of a bridge across the light emission opening from the reflector. Strip 22 is fitted into two slits, located diametrically across from each other in the reflector 2, and there retained by clamps 23', and projecting flaps 23. The flat strip 22 has an essentially semispherical cap 24 secured thereto, which shields direct light emission from the lamp. A ring-like ridge 25 is formed interiorly of the cap 24 into which a slot is formed, matched to fit and to receive the end 26 of the tubular element 19 which is remote from the base 9. The tubular element 19, thus, is securely retained in position in a simple manner between the reflector 2 in the region surrounding its opening 8 and the cap 24. The cap 24, for example of high temperature resistant plastic material, may be mirrored on the inside to reflect radiation back towards the reflector.

The embodiment of FIG. 3 is quite similar to that of FIG. 2, except that the handling unit 27 is made of a metallic punched element 31, for example of Elox-coated aluminum. The cap 28, essentially semispherical, is so dimensioned that its external diameter just fits within the internal diameter of the heat damming and heat retention tube 29. End portion 30 of the heat damming tube 29 engages at the outside of the cap 28. A compressible ring 32, for example of plastic or rubbery or rubber-like material, a metallic leaf spring, or a spring ring, is fitted against the essentially semicircular cap 28, for example by being fitted within a shallow groove, notch or recess of the tube 29, or against a small external bulge on cap 28 or against strip 31. The ring 32, which is best termed a sealing element, simultaneously seals the heat retention chamber formed within the tube 29 and the interior of the cap 28 while permitting changes in dimension due to thermal expansion. The tube 29 can be coated with an ITO layer, in dependence on the color temperature which is desired.

Various types of layers can be used, and the table attached hereto, and forming part of this specification, shows various possibilities. Rather than using a simple metal oxide layer, a combination of plurality of layers with, alternating, high and low indexes of refraction, can be used, thus forming an interference filter. For example, $SiO_2$ and $Ta_2O_5$ layers may be used.

The heat retention tube 14, 19, 29, respectively, and its construction, material, and other characteristics, have substantial influence on the operating data of the reflector-type lamp, formed of the light source—reflector combination. The table shows the color index $R_a$, the color temperature $t_n$ in Kelvin, K, and light output in lumens per watt (lm/W) for a 35 W lamp. As clearly seen in the table, the heat retention tube provides for an improvement in the color rendition, by decreasing the color temperature by 500 K, or more. In dependence on the color temperature desired, a coated heat retention tube ($T_n$ of about 3500 K) can be used, or an uncoated heat retention tube ($T_n$ of about 4000 K) is suitable. Different fills permit even lower color temperatures.

The heat retention or heat damming tube further permits optimization of other characteristics of light source—reflector combination lamps. When using a tube of hard glass, UV emission of the lamp is effectively inhibited. The coating of the heat emission tube can be so selected that additional color effects can be obtained, thereby permitting selected change of the color index and the color temperature as desired. The heat retention tube has the additional advantage to form a protective element in case of possible explosion of the discharge 20 vessel.

Various changes and modifications may be made, and any features described herein may be used with any of the others, within the scope of the inventive concept.

A typical internal diameter for tube 14, 19, 29 is: 18 mm and a typical maximum outside diameter of the discharge vessel 1 is: 10 mm For a 35 W lamp, the volume of the closed heat retention chamber is: 6,2 $cm^3$ and the volume of the discharge vessel 1 and base portions within the chamber is 0,45 $cm^3$, leaving a free volume of 93% of the total volume within the chamber.

TABLE

| Type of lamp | Ra | Tn (K) | L.A. (lm/W) |
|---|---|---|---|
| without retention tube | 57 | 4133 | 41.6 |
| with retention tube (quartz glass) | 63 | 4012 | 42.1 |
| with retention tube (hard glass) | 63 | 4020 | 42.2 |
| with retention tube and ITO layer | 69 | 3544 | 43.9 |

Abbreviations:
Ra = color index
Tn = color temperature in K
L.A. = light output in lm/W

We claim:

1. Compact reflector lamp having a single ended light source including a discharge vessel (1);

a single pinch or press seal (3) at an end of the discharge vessel;

a fill of mercury, a noble gas, and metal halides within the discharge vessel;

two electrodes (4, 5, 7) extending through the pinch seal into the discharge vessel and outside thereof;

a base (9) at one end of the pinch or press seal;

terminal elements (11) secured to the base, and electrically connected to the electrodes; and a curved reflector (2) defining a light emission opening (17), said reflector being formed with an opening (8) at a central region thereof remote from said light emission opening to permit passage of the discharge vessel therethrough, and defining a reflector axis passing through said opening said base (9) being retained in said opening, and comprising, in accordance with the invention, means for controlling the color temperature of the light emitted by said light source by controlling the operating temperature parameters of the light source, including a transparent tubular element (14, 19, 29) separate from said light source closely surrounding the discharge vessel, said tubular element being positioned in the direction of said reflector axis;

means (**10, 16'; 16*a*, 21, 27) for seating a first end portion (16) of said transparent tubular element (14, 19, 29) on the reflector in the region of the reflector which surrounds said opening (8); and means (15', 24, 28) for closing a second end portion (15, 26, 30**) of said transparent tubular element remote from said first end portion, said tubular element being closed by said seating means, the reflector, and said base, and by said closing means and defining a heat retention and heat damming chamber to thereby control the operating temperature of the light source.

2. The lamp of claim 1, wherein said transparent tubular element comprises a tube of hard glass.

3. The lamp of claim 1, wherein said transparent tubular element comprises a tube of quartz glass.

4. The lamp of claim 1, wherein (FIGS. 1 and 4) the transparent tubular element comprises at least one of: a tube of hard glass; a tube of quartz glass; and wherein the closing means comprises a closing cap (15') integral with said transparent tube.

5. The lamp of claim 1, wherein (FIGS. 2, 3) said transparent tubular element comprises at least one of:

hard glass or quartz glass;

said tubular element is a tube open at said second end portion; and wherein the closing means comprises a cap (24, 28) fitted against said second end portion.

6. The lamp of claim 1, further including a transparent cover plate or disk (18) closing off the light emission opening (17) from said reflector.

7. The lamp of claim 4, further including a transparent cover plate or disk (18) closing off the light emission opening (17) from said reflector.

8. The lamp of claim 7, wherein the outer surface of said closing cap (15') engages against the inside of the cover plate or disk (18).

9. The lamp of claim 1, wherein said closing means are formed with a mirror surface to reflect light from said discharge vessel (1) towards the reflector.

10. The lamp of claim 4, wherein said closing means are formed with a mirror surface to reflect light from said discharge vessel (1) towards the reflector.

11. The lamp of claim 5, wherein said closing means are formed with a mirror surface to reflect light from said discharge vessel (1) towards the reflector.

12. The lamp of claim 1, further including a metal oxide layer on said tubular element having the characteristics of controlling the transmission of radiation emitted from said discharge vessel through said layer.

13. The lamp of claim 4, further including a metal oxide layer on said tubular element having the characteristics of controlling the transmission of radiation emitted from said discharge vessel through said layer.

14. The lamp of claim 5, further including a metal oxide layer on said tubular element having the characteristics of controlling the transmission of radiation emitted from said discharge vessel through said layer.

15. The lamp of claim 1, wherein (FIG. 1A) the reflector is a parabolic aluminum reflector having a contour formed by a plurality of facets or reflecting surface elements.

16. The lamp of claim 1, wherein (FIGS. 2, 3) the tubular element comprises a tube open at the second end portion;

a flat bridging element (22, 31) spanning across said light emission opening (14) of the reflector adjacent the light emission opening therefrom, with a narrow edge facing the apex of the reflector; and wherein said closing means comprises a cap (24, 28) secured to said bridging strip (22, 31), engaging and sealed against said tubular element to close the tubular element at the second end portion and thereby form said heat retention or heat damming chamber.

17. The lamp of claim 16, further including resiliently compressible and expandible sealing means (16', 32) located adjacent at least one of the end portions of said tubular element for sealing said heat retention and heat damming chamber while permitting relative change in dimension due to thermal expansion of at least one of: said tubular element; said reflector.

18. The lamp of claim 1, wherein said lamp has a power rating of between about 30 to 100 W, and a color temperature, when in operation, of below about 4100 K.

19. The lamp of claim 1, wherein said tubular element is seated directly against the reflector.

20. The lamp of claim 1, further including resilient sealing means (**16', 16*a*) between the reflector and said first end portion (16**) of the transparent tubular element for sealing said heat retention and heat damming chamber and forming a resilient seat for said first end portion on the reflector.

* * * * *